US008196975B2

(12) United States Patent
Jankowski et al.

(10) Patent No.: US 8,196,975 B2
(45) Date of Patent: Jun. 12, 2012

(54) SAFETY DEVICE FOR VEHICLE DOOR LATCH SYSTEMS

(75) Inventors: Krystof Peter Jankowski, Waterford, MI (US); Ehab Kamal, Novi, MI (US); Lynn Dadeppo, Bloomfield Hills, MI (US)

(73) Assignee: Magna Closures Inc, Newmarket, Ontario (CA)

( * ) Notice: Subject to any disclaimer, the term of this patent is extended or adjusted under 35 U.S.C. 154(b) by 157 days.

(21) Appl. No.: 12/190,707

(22) Filed: Aug. 13, 2008

(65) Prior Publication Data

US 2009/0044378 A1 Feb. 19, 2009

Related U.S. Application Data

(60) Provisional application No. 60/964,611, filed on Aug. 14, 2007.

(51) Int. Cl.
*E05C 3/16* (2006.01)

(52) U.S. Cl. ..... 292/216; 292/201; 292/DIG. 23; 292/DIG. 22

(58) Field of Classification Search ..... 292/201, 292/216, DIG. 22, DIG. 23, DIG. 62, DIG. 56
See application file for complete search history.

(56) References Cited

U.S. PATENT DOCUMENTS

| | | | | |
|---|---|---|---|---|
| 4,503,170 | A | 3/1985 | Drake et al. | |
| 4,503,952 | A | 3/1985 | Hesse | |
| 4,542,791 | A | 9/1985 | Drake et al. | |
| 4,982,782 | A | 1/1991 | Albers et al. | |
| 4,982,792 | A | 1/1991 | Hunt, III et al. | |
| 5,645,138 | A | 7/1997 | Tajima et al. | |
| 5,735,557 | A * | 4/1998 | Harvey | 292/216 |
| 6,655,743 | B1 | 12/2003 | Parizat et al. | |
| 6,712,409 | B2 | 3/2004 | Monig | |
| 6,946,138 | B2 | 9/2005 | Iwai et al. | |
| 7,097,212 | B2 * | 8/2006 | Willats et al. | 292/1 |
| 7,226,878 | B2 | 6/2007 | Wagner et al. | |
| 7,264,283 | B2 | 9/2007 | Stoof et al. | |
| 7,342,049 | B2 | 3/2008 | Minemura et al. | |
| 2002/0148075 | A1 * | 10/2002 | Monig | 16/412 |
| 2002/0171067 | A1 | 11/2002 | Jolly et al. | |
| 2004/0173422 | A1 | 9/2004 | Deshukh et al. | |
| 2005/0037189 | A1 | 2/2005 | Palmer et al. | |
| 2005/0121920 | A1 | 6/2005 | Machia | |
| 2006/0234577 | A1 | 10/2006 | Wagner et al. | |
| 2007/0200357 | A1 * | 8/2007 | Westerwick et al. | 292/201 |

OTHER PUBLICATIONS

Eric D. Wetzel, et al,"The Effect of Rheological Parameters on the Ballistic Properties of Shear Thickening Fluid (STF)—Kevlar Composites"NUMIFORM 2004. Jun. 13-17, 2004. Columbus, OH.
Young S. Lee, et al, "The ballistic impact characteristics of Kevlar R woven fabrics impregnated with a colloidalshear thickening fluid" Journal of Materials Science 38 (2003).

* cited by examiner

*Primary Examiner* — Kristina Fulton
(74) *Attorney, Agent, or Firm* — Miller Canfield

(57) ABSTRACT

A motion restriction device is provided for selectively preventing movement of a structural member. The motion restriction device includes a container abutting against the structural member. The container is at least partially filled with a velocity-dependent material that transitions between a fluid-like state when the structural member moves at a velocity below a predetermined threshold to permit movement thereof and a solid-like state when the structural member moves at a velocity above a predetermined threshold to block movement thereof.

21 Claims, 12 Drawing Sheets

SAFETY DEVICE FOR VEHICLE DOOR LATCH SYSTEMS

This application claim the benefits of U.S. Provisional Application No. 60/964,611, filed Aug. 14, 2007.

BACKGROUND

The invention relates to the use of a motion restriction device including a velocity-dependent material for selectively preventing movement of a member, and to the use of such motion restriction devices in various vehicle components and systems.

SUMMARY

According to one aspect of the invention, a motion restriction device is provided for selectively preventing movement of a member. The motion restriction device includes a container abutting against the member. The container is at least partially filled with a velocity-dependent material that transitions between a fluid-like state when the member moves at a velocity below a predetermined threshold to permit movement thereof, and a solid-like state when the member moves at a velocity above a predetermined threshold to block movement thereof.

According to another aspect of the invention, a motion restriction device is provided for selectively preventing rotation of a rotatable member when the rotatable member moves at a velocity above a predetermined threshold. The motion restriction device includes a container operably coupled to the rotatable member. The container is at least partially filled with a velocity-dependent material that transitions between a fluid-like state at a velocity below the predetermined threshold to permit rotation of the rotatable member and a solid-like state at a velocity above the predetermined threshold to block rotation of the rotatable member.

BRIEF DESCRIPTION OF THE DRAWINGS

The embodiments of the invention will be readily appreciated as the same becomes better understood by reference to the following detailed description when considered in connection with the accompanying drawings wherein.

DETAILED DESCRIPTION OF THE EMBODIMENTS

Figure 1:
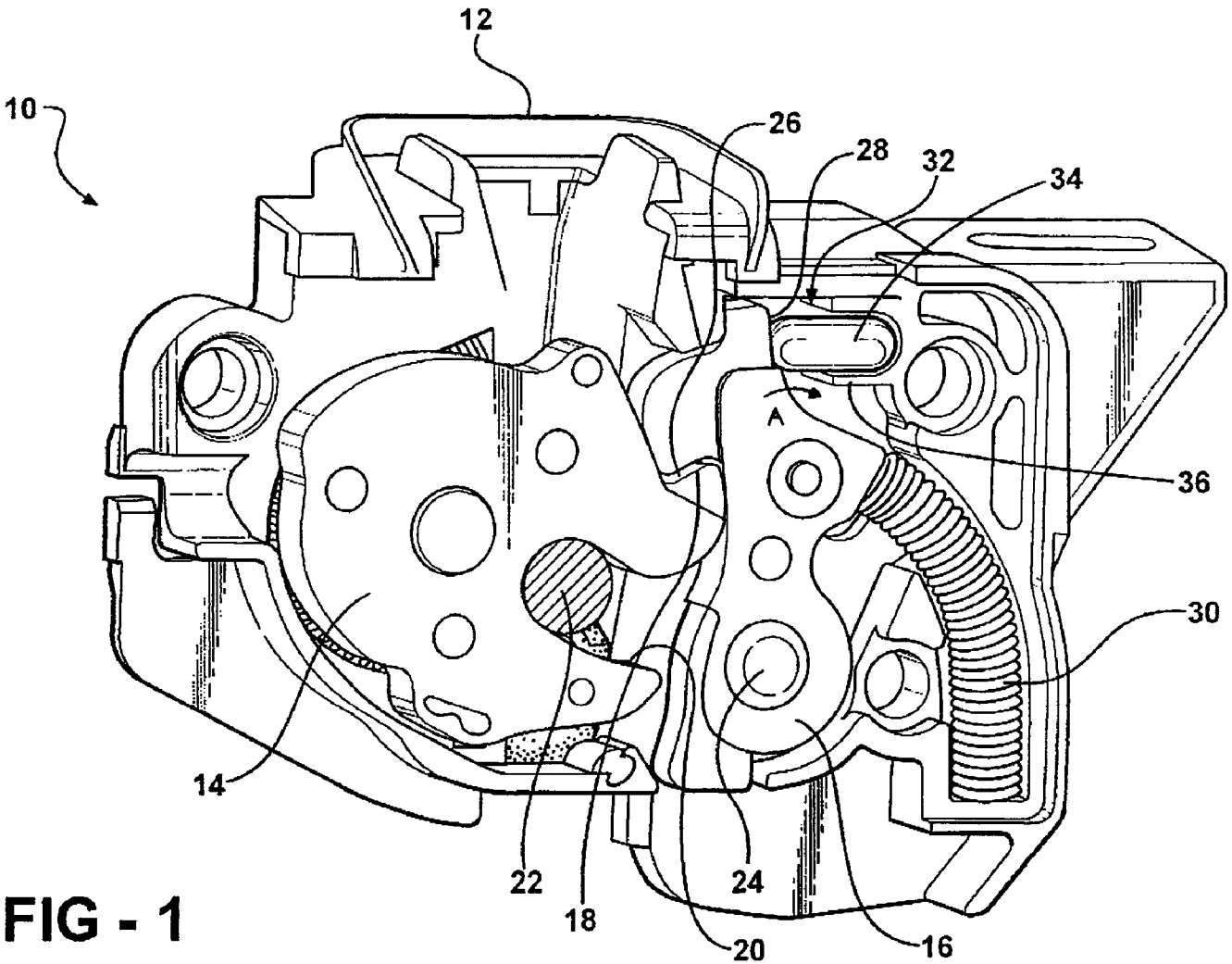
FIG. 1 is a perspective view of a door latch assembly including a pawl maintaining a ratchet in a latched position.
Figure 2:
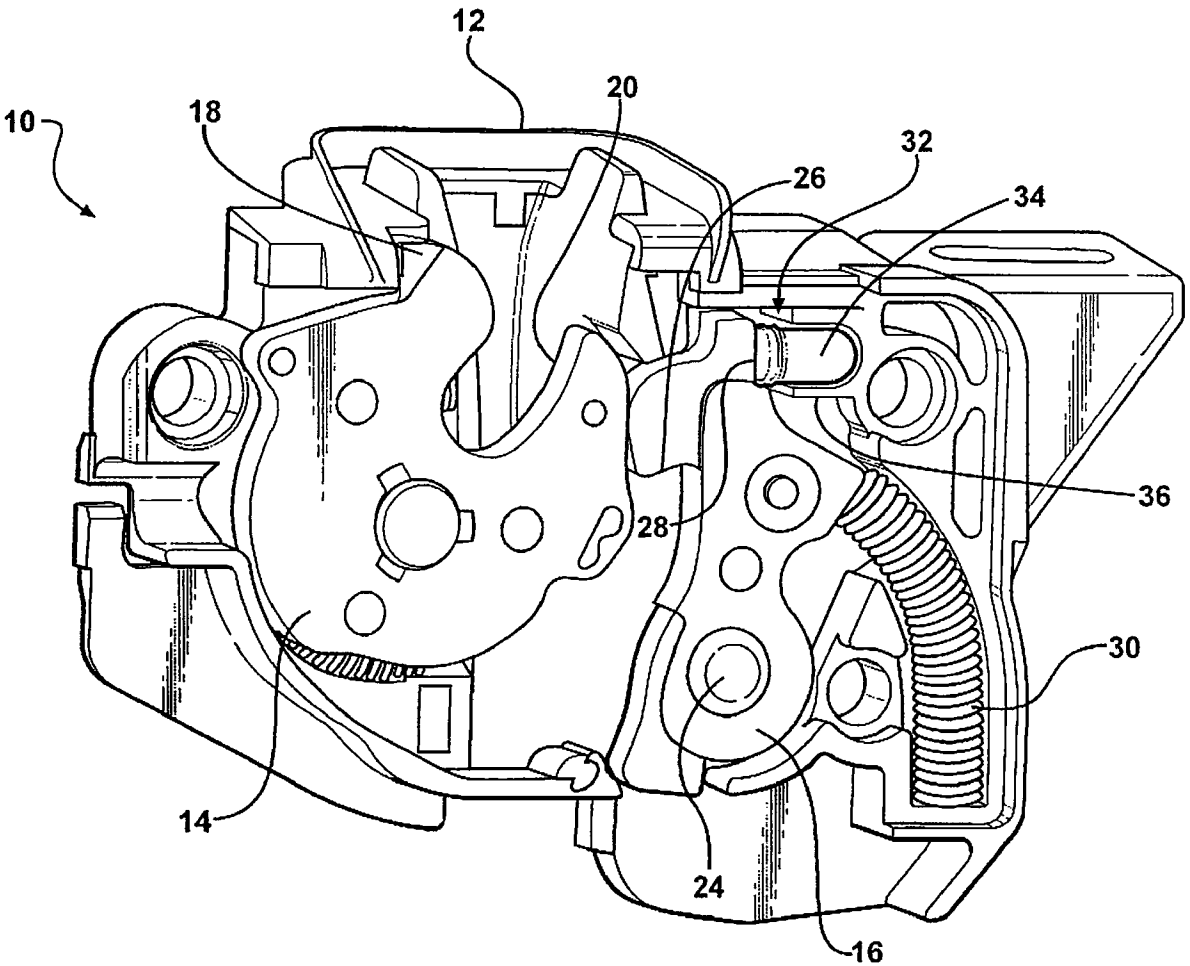
FIG. 2 is a perspective view of the door latch assembly including the ratchet in an unlatched position.
Figure 3:
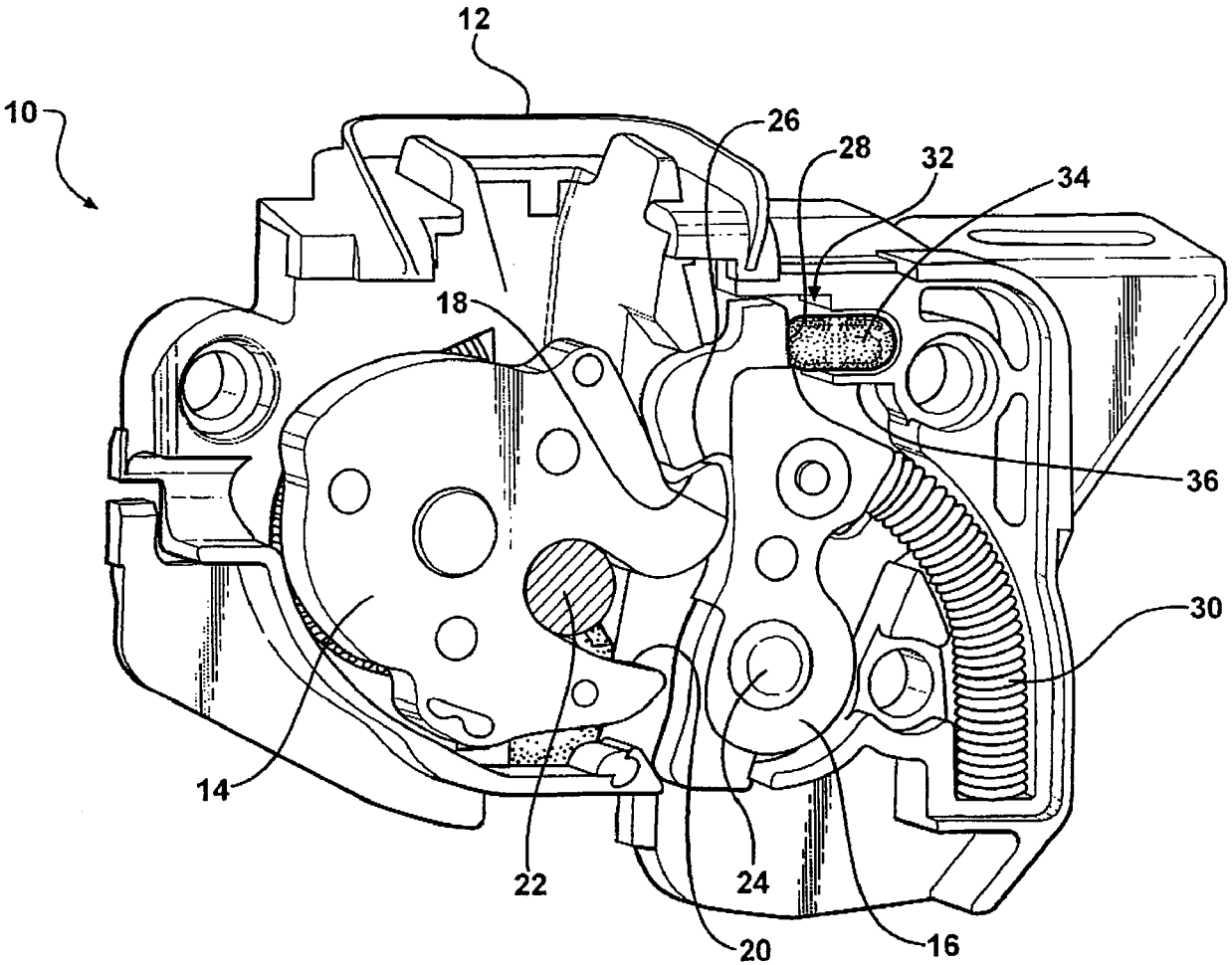
FIG. 3 is a perspective view of the door latch assembly including a motion restriction device in one embodiment maintaining the ratchet in the latched position as the pawl moves at a velocity above a pre-determined threshold.
Figure 4:
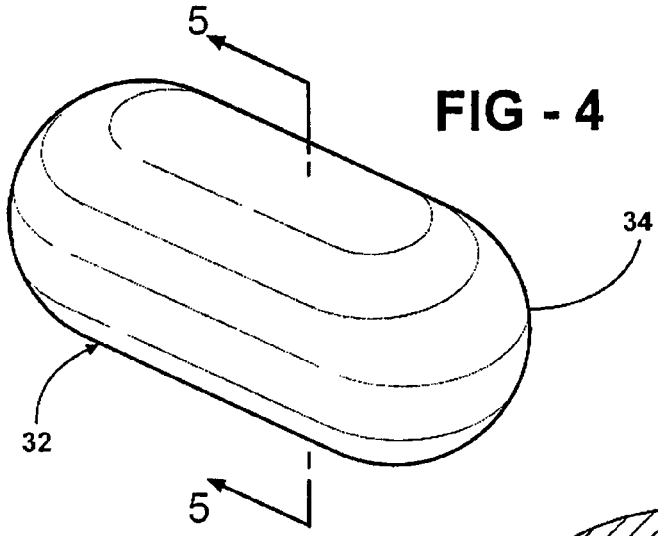
FIG. 4 is a perspective view of a capsule filled with a velocity-dependent material in one embodiment.
Figure 5:
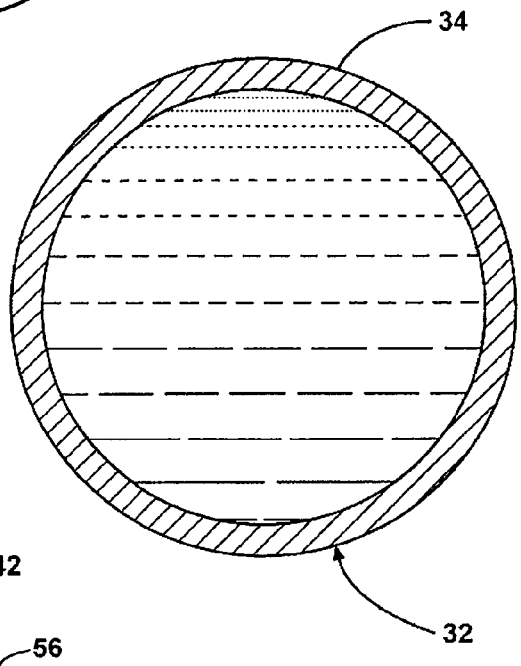
FIG. 5 is a cross-sectional view taken along lines 5-5 in FIG. 4.
Figure 9:
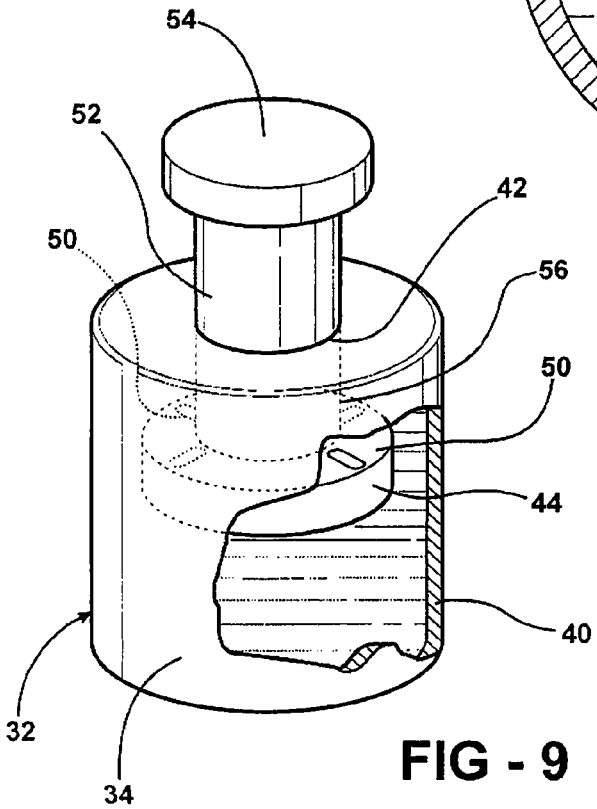
FIG. 9 is a perspective view of the motion restriction device including a cylinder and a piston.

Referring to FIGS. 1 through 3, a door latch assembly, generally shown at 10, includes a housing 12 adapted to be attached to a motor vehicle door. The motor vehicle door may be, but is not limited to, a side door, a liftgate, a hood, a decklid, a sliding door, or a cargo door. A first member or ratchet 14 and a second member or pawl 16 each are rotatably mounted to the housing 12. The ratchet 14 includes a shoulder 18 and defines an opening 20. The ratchet 14 is movable between a latched position, shown in FIG. 1, in which a striker 22 positioned along a motor vehicle body is retained within the opening 20 to lock the motor vehicle door and an unlatched position, shown in FIG. 2, in which the striker 22 is released from the ratchet 14 to allow opening of the motor vehicle door. A spring biases the ratchet 14 towards the unlatched position.

The pawl 16 is rotatable about a pin 24. The pawl 16 includes a retention portion 26 and a contact edge 28. When the pawl 16 is in a pawl engagement position, shown in FIG. 1, the retention portion 26 engages the shoulder 18 to maintain the ratchet 14 in the latched position. When the pawl 16 is moved out of the pawl engagement position, the ratchet 14 is free to move from the latched position to the unlatched position. A spring 30 biases the pawl 16 towards the pawl engagement position.

The door latch assembly 10 includes a motion restriction device, generally indicated at 32, positioned along the housing 12. In one embodiment, the motion restriction device 32 selectively prevents or blocks movement of the pawl 16 out of the pawl engagement position. Alternatively, it is contemplated that the motion restriction device 32 could selectively prevent or block movement of any other member that is linked to the pawl 16 or is otherwise present in the latch release chain. The specific member or part that the motion restriction device acts upon depends upon the mechanism into which it is incorporated as well as the location of the motion restriction device on the mechanism. The motion restriction device 32 includes a container 34 that is at least partially filled with a velocity-dependent material. The container 34 may be formed from any of various materials and may have any of numerous configurations, shapes, and sizes. In addition, the amount of velocity-dependent material in the container 34 may vary.

The velocity-dependent material can be a fluid, gel, foam, or like material. The velocity-dependent material also includes solid particles. The velocity-dependent material transitions between a fluid-like state having a low viscosity and providing only negligible or limited resistance to deformation, and a solid-like state having a high viscosity and providing considerable resistance to deformation. Whether the velocity-dependent material acts as a fluid or a solid depends upon the velocity of the member acting upon the motion restriction device. If the velocity of the member is below a predetermined threshold, such as would occur at rest or during normal operation of the desired mechanism, the velocity-dependent material will be in a fluid-like state. On the other hand, if the velocity of the member is above a predetermined threshold, the solid particles aggregate and the velocity-dependent material will be in a solid-like state. Once the velocity of the member drops below the predetermined threshold, the velocity-dependent material transitions back to the fluid-like state. Thus, a single motion restriction device 32 with the velocity-dependent material may be utilized to permit movement of a member or component in certain situations and prevent the same movement in other situations.

In one embodiment, shown in FIGS. 1 through 5, the container 34 in the motion restriction device 32 is a capsule that abuts the contact edge 28 of the pawl 16 to selectively prevent movement of the pawl 16 out of the pawl engagement position. The capsule 34 is maintained in position along the housing 12 by at least one retaining wall 36. The capsule 34 in the embodiment is formed from a compressible material, such as an elastomeric material. During normal operation of the door latch assembly 10, the velocity-dependent material inside the capsule is in a fluid-like state. Thus, the compressible capsule 34 will deform inwardly upon application of a force thereagainst, such as by the movement of the pawl 16 out of the pawl engagement position. However, when a force at a rate above a predetermined threshold is applied to the capsule 34, the velocity-dependent material inside the capsule 34 is in a solid-like state. Thus, the capsule 34 will not deform inwardly at all but instead retains its shape.

In operation, starting with the ratchet 14 in the latched position, as shown in FIG. 1, when the pawl 16 is pulled out of the pawl engagement position during normal operation of the door latch assembly 10 (by an inside release lever or outside release lever), the contact edge 28 of the pawl 16 moves against the capsule 34 in the direction of arrow A. Since the velocity of the pawl 16 is below a predetermined threshold, the velocity-dependent material inside the capsule 34 remains in a fluid-like state. Therefore, the capsule 34 provides little resistance to movement of the pawl 16 thereagainst. More specifically, the capsule 34 compresses, as shown in FIG. 2, to allow the pawl 16 to move out of the pawl engagement position. As a result, the ratchet 14 is free to move from the latched position to the unlatched position and release the striker 22.

In contrast, when the pawl 16 is urged into movement at a velocity above a pre-determined threshold, the velocity-dependent material inside the capsule 34 immediately transitions from the fluid-like state to a solid-like state. Thus, when the contact edge 28 of the pawl 16 is urged against the capsule 34 in the direction of arrow A at a rate above the predetermined threshold, the capsule 34 resists the pawl 16. More specifically, the capsule 34 cannot be compressed and the pawl 16 is not able to move out of the pawl engagement position (see FIG. 3). As a result, the ratchet 14 remains in the latched position. However, once the pawl 16 ceases to move at a velocity above the predetermined threshold, the velocity-dependent material transitions back to the fluid-like state to permit the pawl 16 to move out of the pawl engagement position during normal operation of the door latch assembly 10.

Referring to FIGS. 6 through 9, in another embodiment the container 34 for the motion restriction device 32 is a cylinder having an inner cylindrical wall 40 and an opening 42 at one end. The cylinder 34 is filled with the velocity-dependent material. A piston 44 is disposed within the cylinder 34 and may include a number of orifices or slots 50. The particular diameter of the piston 44 may vary. A piston rod 52 extends through the opening 42 of the cylinder 34. The piston rod 52 includes a first end 54 disposed outside the cylinder 34 and an opposing second end 56 fixedly secured to the piston 44. A force applied to the first end 54 of the piston rod 52 provides linear movement of the piston rod 52 and the piston 44 within the cylinder 34. It is contemplated that an implementation without the piston 44, i.e. with the piston rod 52 alone, may also be utilized.

The motion restriction device 32 in the current embodiment, including the cylinder 34 filled with the velocity-dependent material, is positioned along the housing 12 such that the first end 54 of the piston rod 52 abuts against the contact edge 28 of the pawl 16.

Figure 6:
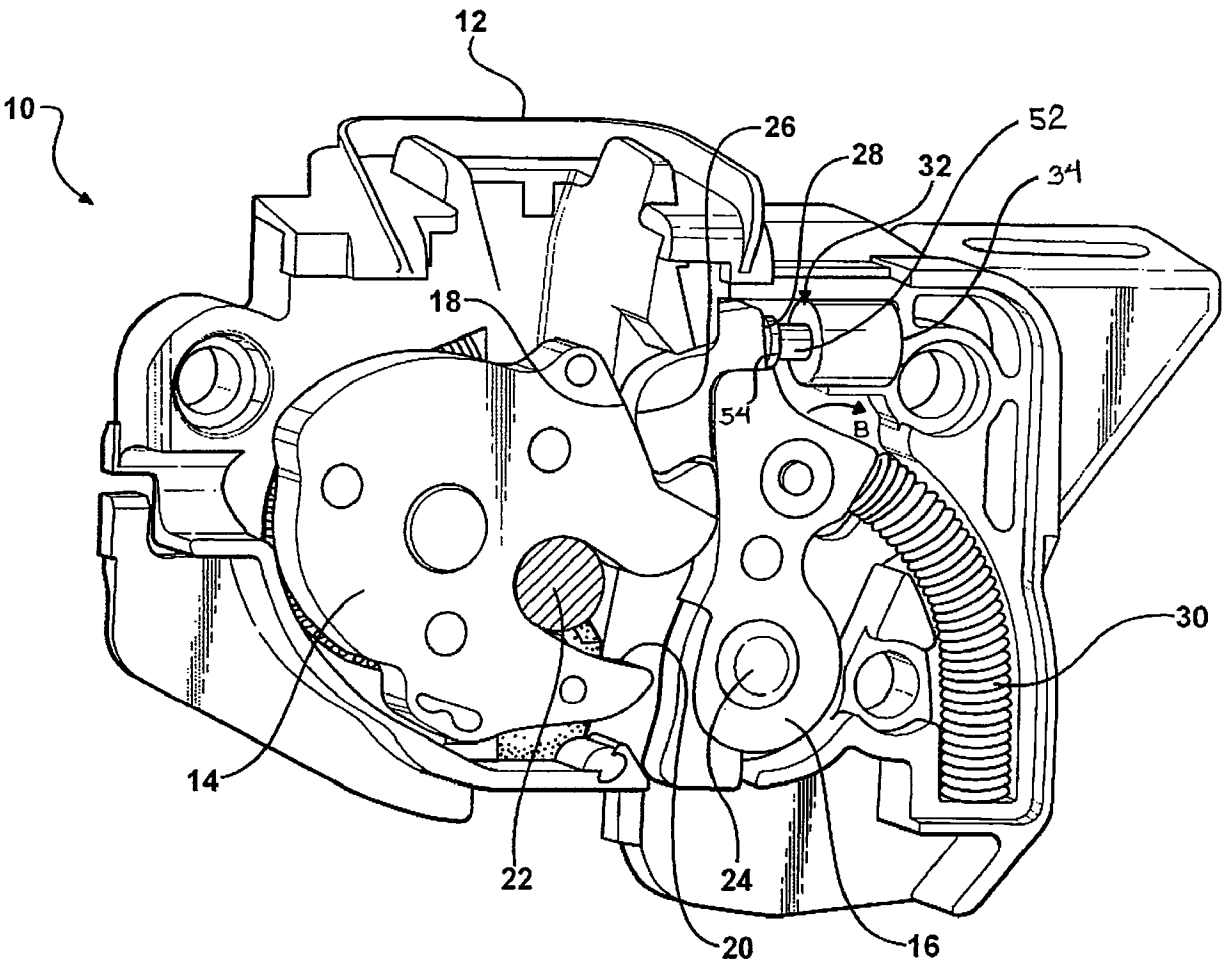
FIG. 6 is a perspective view of the door latch assembly including a motion restriction device in another embodiment positioned adjacent a pawl retaining a ratchet in a latched position.
Figure 7:
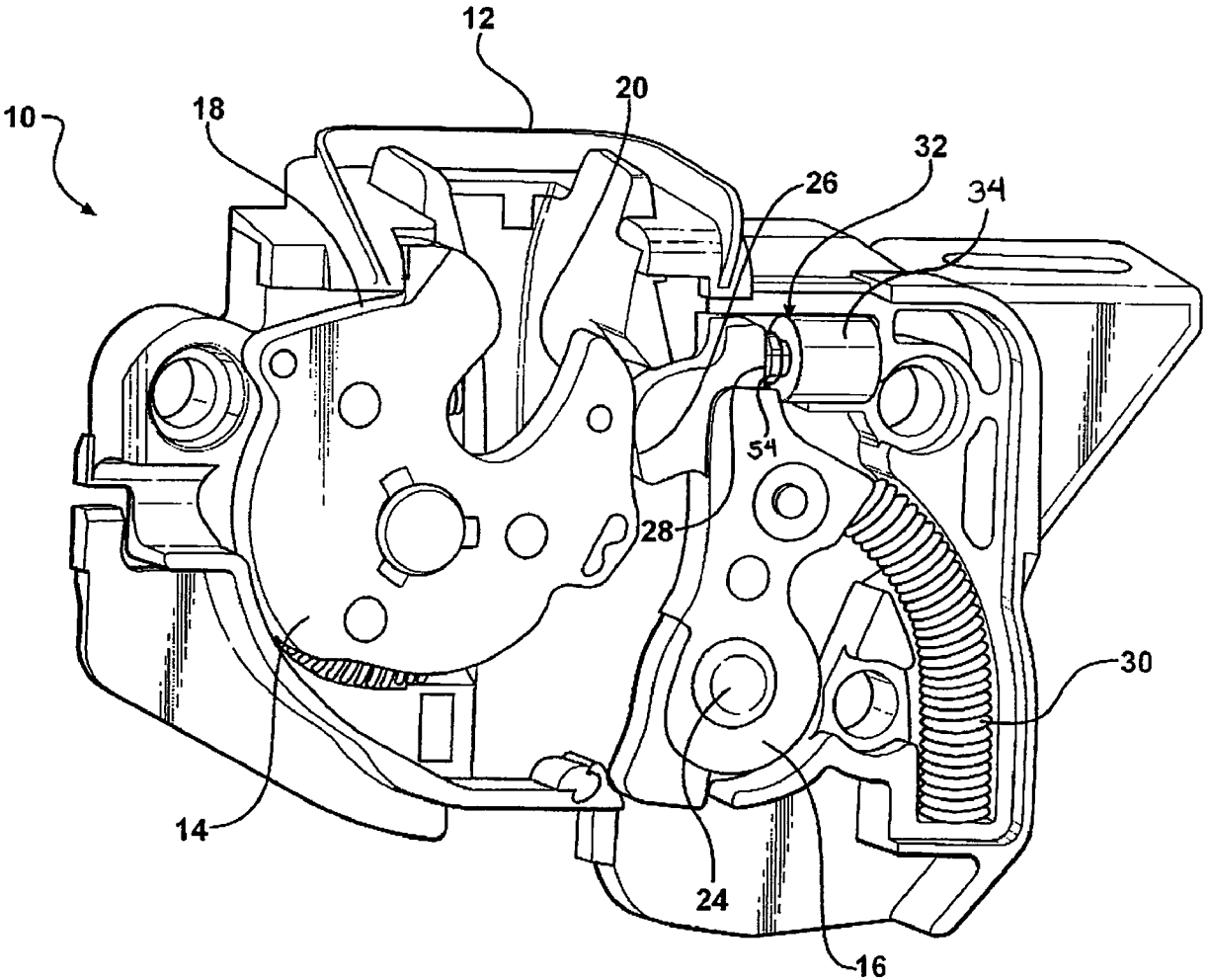
FIG. 7 is a perspective view of the door latch assembly including the ratchet in an unlatched position.

In operation, starting with the ratchet 14 in the latched position as shown in FIG. 6, when the pawl 16 is moved out of the pawl engagement position during normal operation of the door latch assembly 10 (by either the inside release lever or the outside release lever), the contact edge 28 of the pawl 16 moves in the direction of arrow B to press against the first end 54 of the piston rod 52. Because the pawl 16 is moving at a rate below the predetermined threshold, the velocity-dependent material is in a fluid-like state. Thus, when the pawl 16 presses against the piston rod 52, the result is linear movement of the piston rod 52 and the piston 44 through the cylinder 34. The pawl 16 is allowed, therefore, to move out of the pawl engagement position and the ratchet 14 moves to the unlatched position, as shown in FIG. 7.

Figure 8:
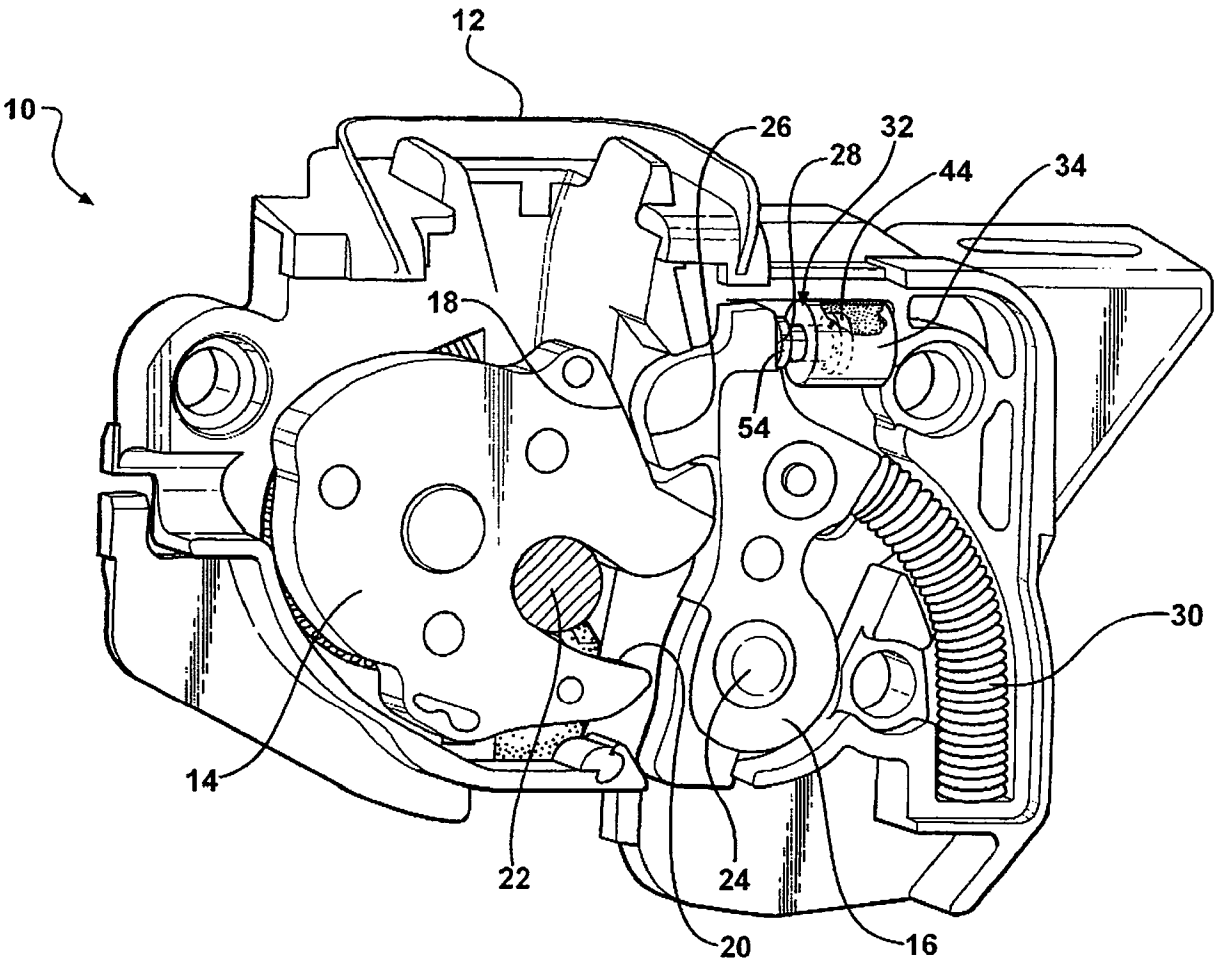
FIG. 8 is a perspective view of the door latch assembly including the motion restriction device maintaining the pawl in engagement with the ratchet as the pawl moves at a velocity above a pre-determined threshold.

In a situation in which the pawl 16 moves at a velocity above a pre-determined threshold, the velocity-dependent material in the cylinder 34 transitions from a fluid-like state to a solid-like state. Thus, when the pawl 16 presses against the first end 54 of the piston rod 52, the piston rod 52 and the piston 44 cannot move within the cylinder 34. The pawl 16 cannot, therefore, move out of the pawl engagement position and the ratchet 14 remains in the latched position, as shown in FIG. 8. However, once the pawl 16 ceases to move at a velocity above the pre-determined threshold, the velocity-dependent material transitions to its fluid-like state and normal operation of the door latch assembly 10 may resume.

Figure 10:
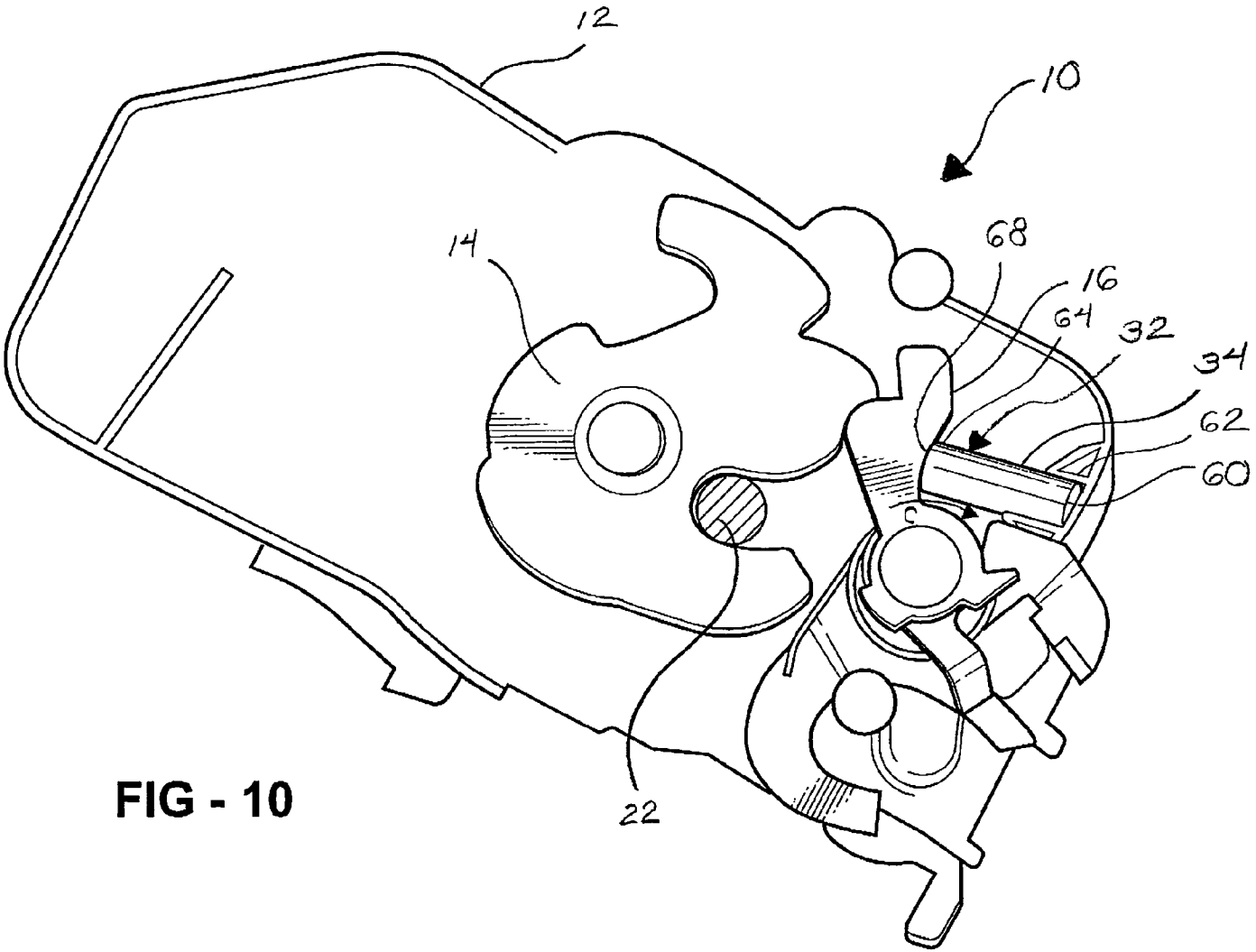
FIG. 10 is a perspective view of the door latch assembly including still another embodiment of the motion restriction device and a pawl maintaining a ratchet in a latched position.
Figure 11:
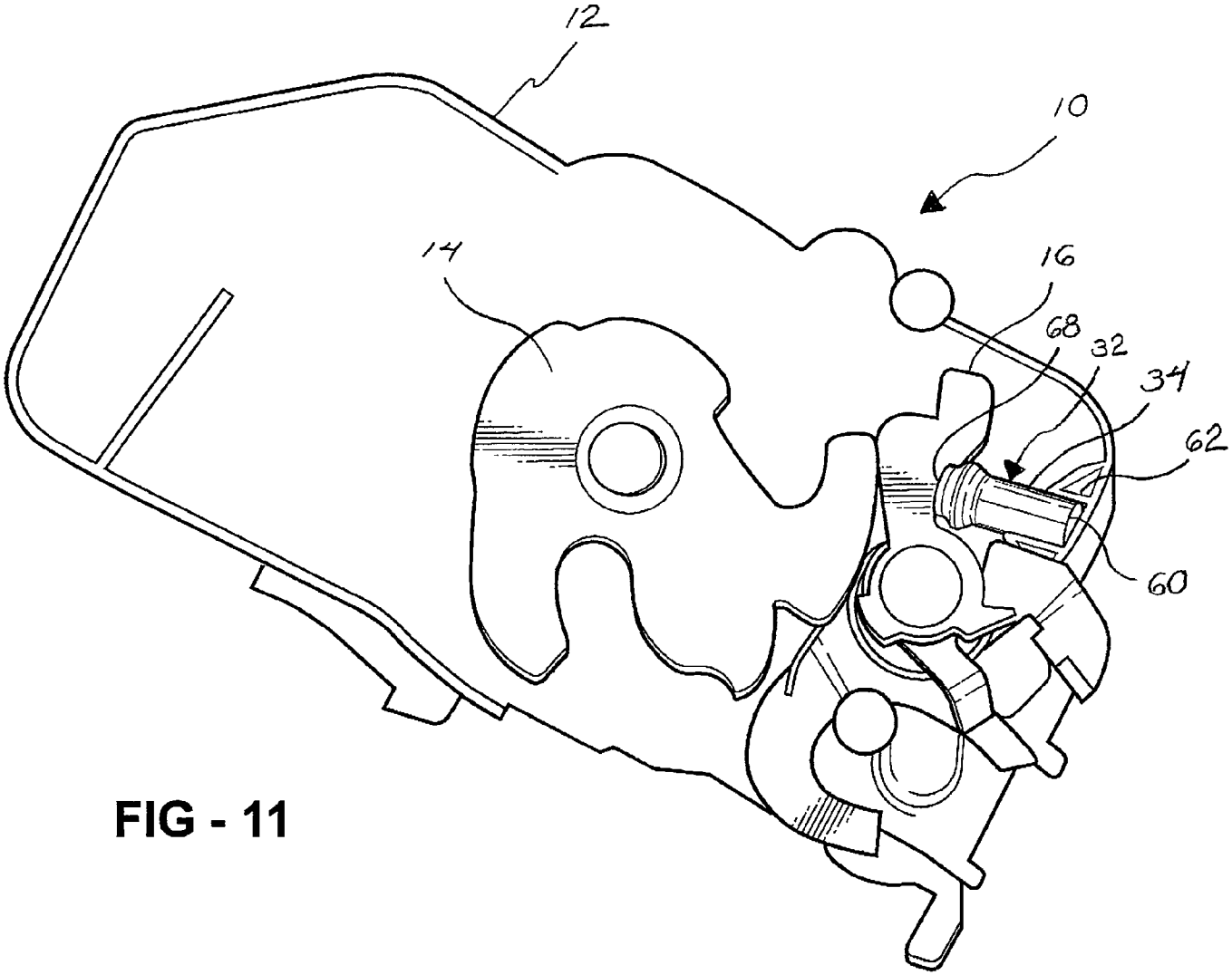
FIG. 11 is a perspective view of the door latch assembly including the ratchet in an unlatched position.
Figure 12:
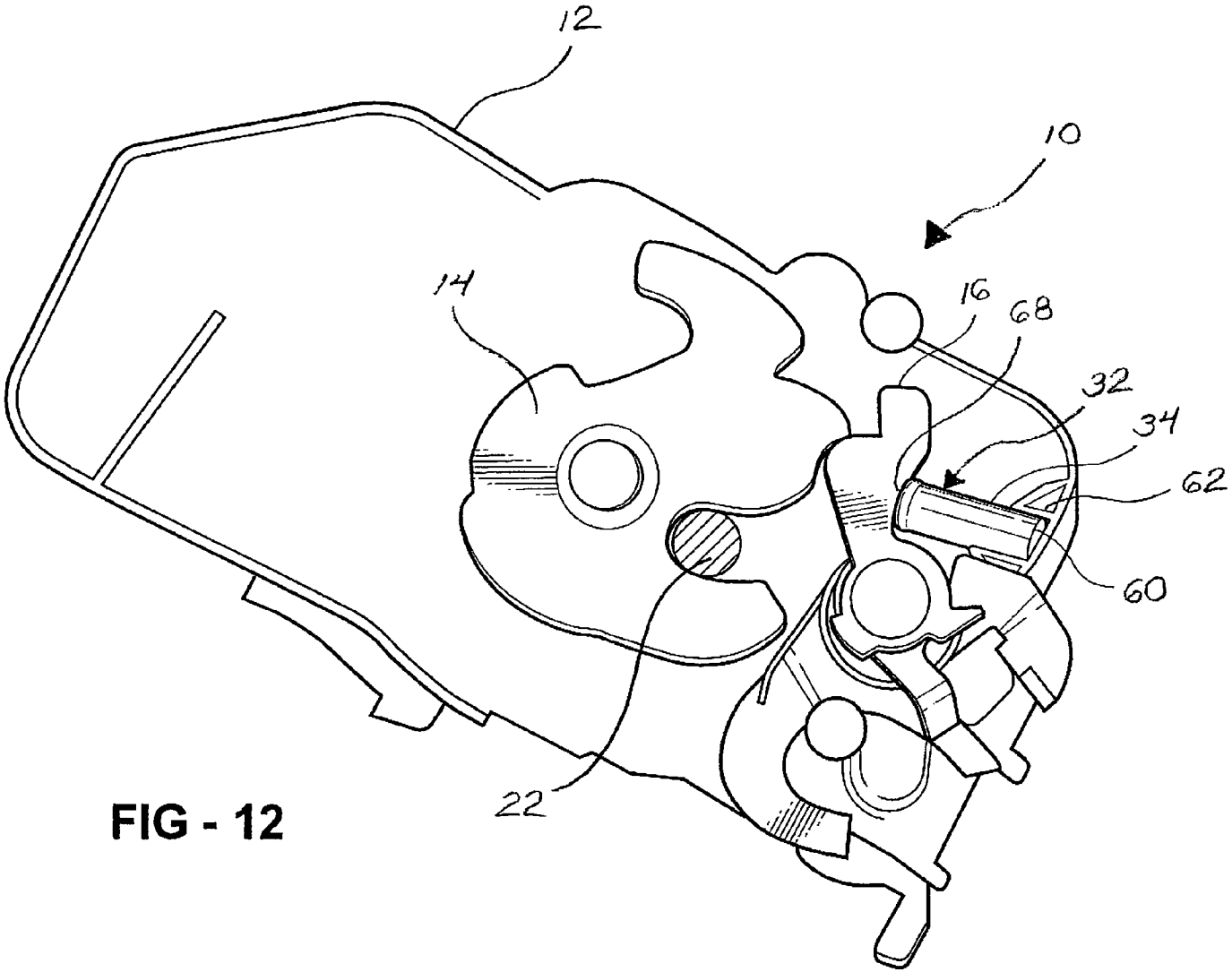
FIG. 12 is a perspective view of the door latch assembly including the motion restriction device maintaining the pawl in engagement with the ratchet as the pawl moves at a velocity above a predetermined threshold.
Figure 13:
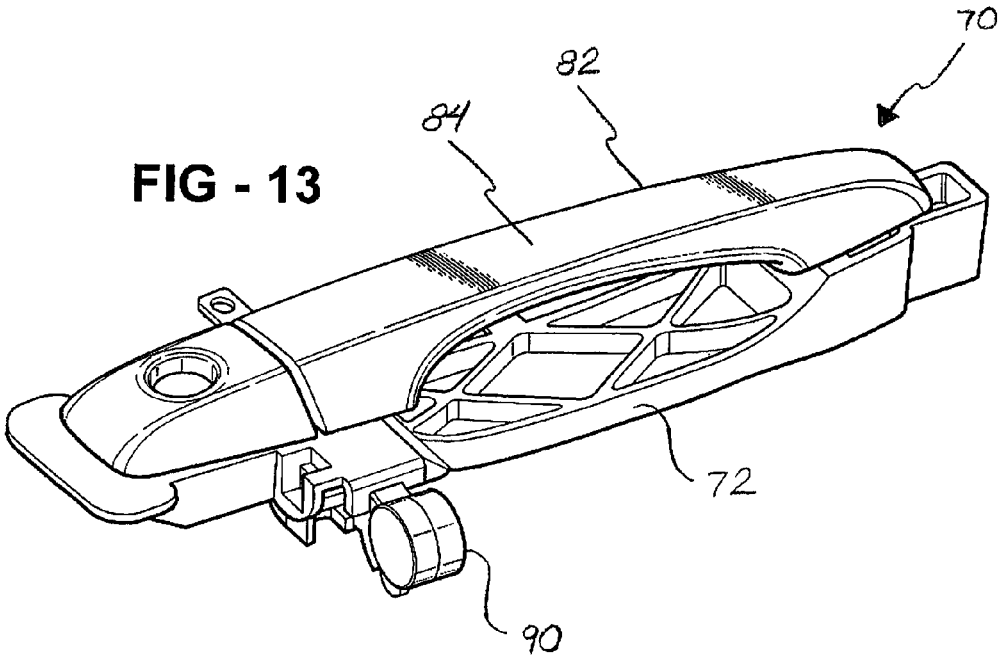
FIG. 13 is an outer perspective view of an outside door handle assembly including a motion restriction device in yet another embodiment.

Referring to FIGS. 10 through 12, in another embodiment of the invention the container 34 in the motion restriction device 32 is a tubular member. The tubular member 34 is a compressible member that may be formed from an elastomeric material. The compressible tubular member 34 is disposed along the housing 12 adjacent the pawl 16, and biases the pawl 16 towards the pawl engagement position. More specifically, one end 60 of the tubular member 34 is held in place by a retaining member 62 at an outer edge 64 of the housing 12, and an opposing end 66 of the tubular member 34 abuts against an engagement surface 68 of the pawl 16. The end 66 of the tubular member 34 may be shaped to complement the engagement surface 68 to ensure a tight, consistent engagement therebetween. The tubular member 34 in this embodiment biases the pawl 16 towards the pawl engagement position.

In operation, starting with the ratchet 14 in the latched position as shown in FIG. 10, when the pawl 16 is pulled out of the pawl engagement position during normal operation of the door latch assembly 10, the engagement surface 68 of the pawl 16 moves against the tubular member 34 in the direction of arrow C. Since the pawl 16 is moving at a velocity below a predetermined threshold, the velocity-dependent material inside the tubular member 34 remains in a fluid-like state. Therefore, the tubular member 34 provides limited resistance to movement of the pawl 16 thereagainst. More specifically, the tubular member 34 compresses, as shown in FIG. 11, to allow the pawl 16 to move out of the pawl engagement position. As a result, the ratchet 14 is free to move from the latched position to the unlatched position and release the striker 22.

When the pawl 16 is urged into movement at a velocity above a pre-determined threshold, the velocity-dependent material transitions from the fluid-like state to a solid-like state. Thus, when the pawl 16 is urged against the tubular member 34 in the direction of arrow C at a velocity above the predetermined threshold, the tubular member 34 resists the pawl 16. More specifically, the tubular member 34 cannot be compressed and the pawl 16 is not able to move out of the pawl engagement position (see FIG. 12). As a result, the ratchet 14 remains in the latched position. However, once the velocity above the pre-determined threshold ceases, the velocity-dependent material transitions back to the fluid-like state to permit movement of the pawl 16 out of the pawl engagement position during normal operation of the door latch assembly 10.

Thus, the tubular member 34 in this embodiment plays a dual role. Specifically, the tubular member 34 biases the pawl 16 towards the pawl engagement position, and selectively blocks or prevents movement of the pawl 16 when the pawl 16 moves at a velocity above a pre-determined threshold.

Referring to FIGS. 13 through 17, a door handle assembly, generally shown at 70, includes the motion restriction device 32 in yet another embodiment. The door handle assembly 70 includes a base 72 adapted to be fixedly secured to the motor vehicle door. An inboard surface 74 of the base 72 includes a mounting portion, generally indicated at 76. The mounting portion 76 includes a pivot mount 78 and a U-shaped member 80 spaced apart therefrom.

The door handle assembly 70 also includes a handle 82 pivotally coupled to the base 72. The handle 82 includes a grip portion 84. A handle finger 86 extends out from the handle 82 and includes a slot 88. When the handle 82 is pivoted relative to the base 72 to open the door, the handle finger 86 moves in the direction of arrow D, as shown in FIG. 14.

A counterweight 90 is positioned along the inboard surface 74 of the base 72 to provide inertia balance to the handle 82. The counterweight 90 includes a mounting formation 92 and a leg 94 extending out therefrom. The mounting formation 92 includes a counterweight shaft 96 having one end disposed within the pivot mount 78. The counterweight shaft 96 is rotatable about an axis Y. The counterweight 90 is biased towards its rest position by a spring. The mounting formation 92 also includes a rod attachment structure 98 for receiving one end of a rod, which at an opposing end is connected to the outside release lever of the door latch assembly 10. The leg 94 includes a distal end 100 positioned within the slot 88 of the finger 86. Upon actuation of the handle 82, the handle finger 86 moves in the direction of arrow D, shown in FIG. 14, to rotate the counterweight 90 against the biasing action of the spring. Through the rod coupling to the door latch assembly 10, the rotation of the counterweight 90 initiates movement of the pawl 16 out of the pawl engagement position thereby freeing the ratchet 14 to move to its unlatched position.

The motion restriction device 32 is disposed along the inboard surface 74 of the base 72. The container 34 at least partially filled with velocity-dependent material is fixedly secured to the base 72 and abuts against the U-shaped member 80. A rotatable member or shaft 102 extends through an aperture 104 formed at each end of the container 34. The rotatable shaft 102 is fixedly secured to the counterweight shaft 96 for rotation therewith about the Y axis. A rotor 106 is fixedly secured to the portion of the rotatable shaft 102 disposed within the container 34. The rotor 106 includes a plurality of blades 108. The container 34 also includes a number of blades 110 that do not interfere with the motion of the rotor 106.

Figure 14:
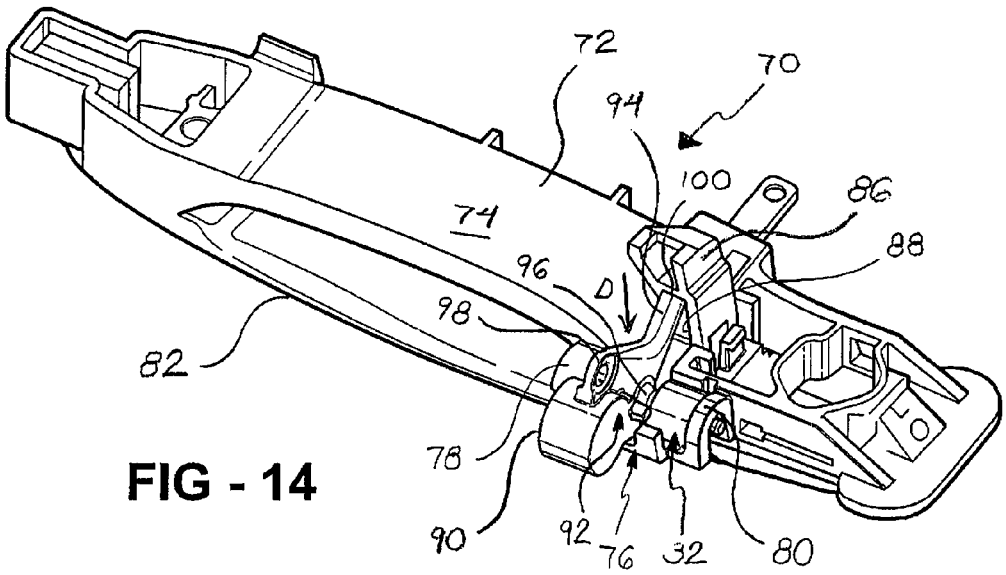
FIG. 14 is an inner perspective view of the outside door handle assembly including the motion restriction device.
Figure 15:
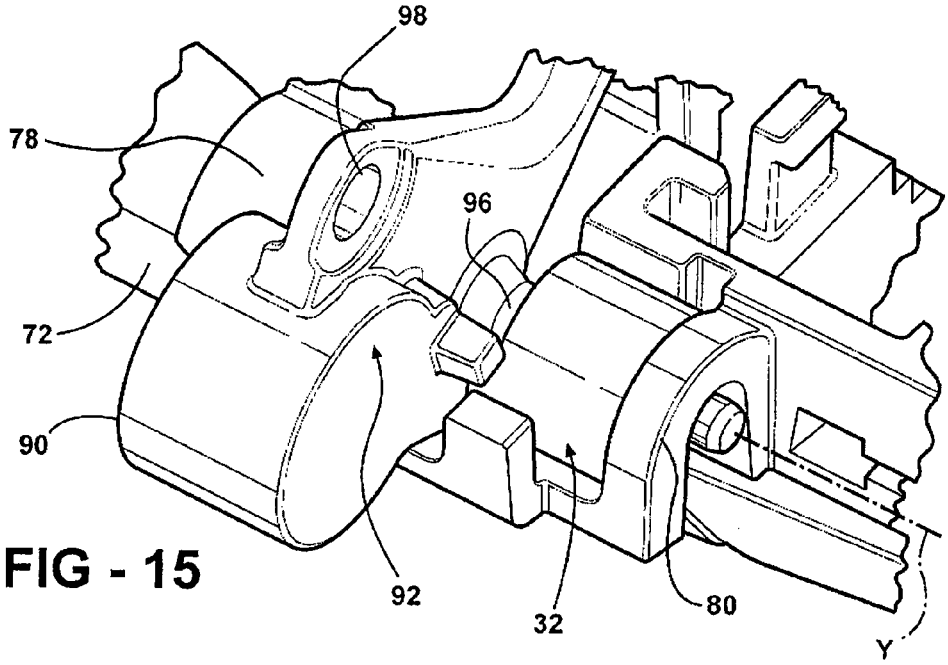
FIG. 15 is a fragmentary perspective view of the outside door handle assembly including a counterweight and the motion restriction device mounted to a base.
Figure 16:
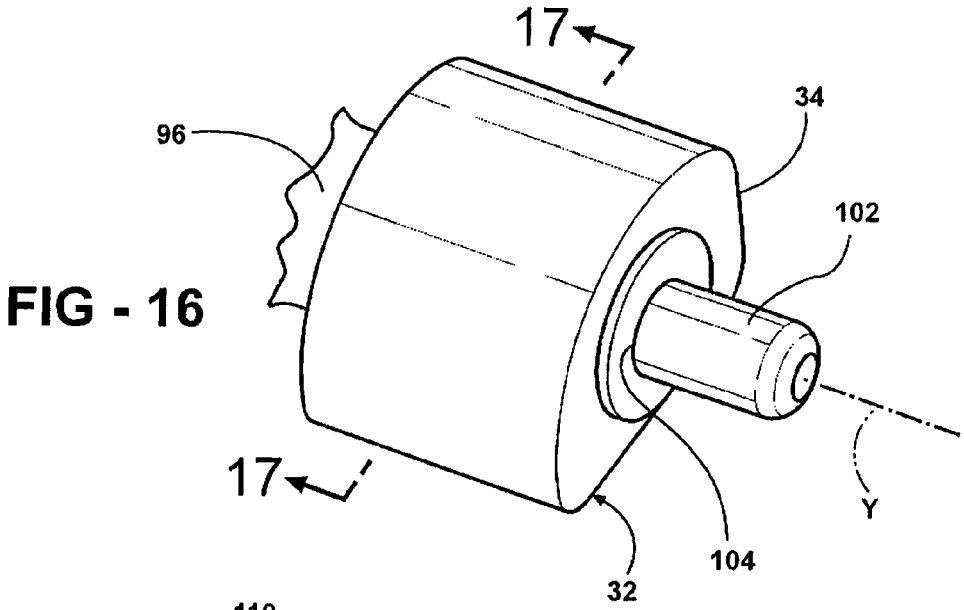
FIG. 16 is a perspective view of the motion restriction device cut away from the base.
Figure 17:
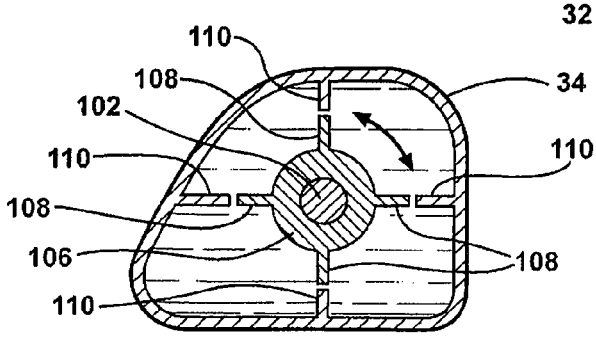
FIG. 17 is a cross-sectional view taken along lines 17-17 in FIG. 16.

In operation, when the door handle assembly 70 is manually actuated by an individual grasping the grip portion 84 to pull the handle 82, the movement of the handle finger 86 in the direction of arrow D, shown in FIG. 14, against the leg 94 causes the rotation of the counterweight 90. Because the velocity acting on the motion restriction device 32 is below a predetermined threshold, the velocity-dependent material within the container 34 is in a fluid-like state. The plurality of blades 108 of the rotor 106 move through the fluid-like velocity-dependent material in the container 34. As a result, the motion restriction device 32 provides little resistance to the rotation of the shafts 102 and 96, and the counterweight 90 rotates about the axis Y to pull one end of the rod. In response, the outside release lever moves the pawl 16 out of the pawl engagement position to allow movement of the ratchet 14 into the unlatched position.

By contrast, in situations in which the velocity acting on the motion restriction device 32 is greater than a predetermined threshold, the velocity-dependent material in the container 34 immediately transitions from the fluid-like state to a solid-like state. Thus, the rotational movement of the plurality of blades 108 of the rotor 106 will slow down significantly and will potentially be brought to a stop. The rotatable shaft 102, and with it the counterweight shaft 96, cannot, therefore, rotate about the axis Y. As a result, the rod connecting the counterweight 90 to the outside release lever is not actuated and the pawl 16 remains in the pawl engagement position maintaining the ratchet 14 in the latched position.

It is appreciated that although the motion restriction device 32 has been shown and described with respect to a door latch assembly and an outside door handle assembly for a motor vehicle, the motion restriction device 32 including the container 34 at least partially filled with the velocity-dependent material may be utilized in any of numerous automotive applications, including but not limited to latch mechanisms, seat belt mechanisms, and headrests, as well as non-automotive applications. The motion restriction device 32 may be utilized to control movement in a single plane as well as in a rotational sense. Moreover, the motion restriction device 32 may directly engage the member to be blocked or it may be operably connected to the member to be blocked.

It is further appreciated that the predetermined threshold for the velocity required to initiate transition of the velocity-dependent material from the fluid-like state to the solid-like state may be adjusted or otherwise tuned to meet the needs of a specific mechanism's unique operating environment.

The invention has been described in an illustrative manner. It is to be understood that the terminology, which has been used, is intended to be in the nature of words of description rather than of limitation. Many modifications and variations of the invention are possible in light of the above teachings.

Therefore, within the scope of the appended claims, the invention may be practiced other than as specifically described.

What is claimed is:

1. A door latch assembly for selectively retaining a striker disposed along a motor vehicle body, said door latch assembly comprising:

a housing adapted to be fixedly secured to a motor vehicle door;

a ratchet rotatably mounted to the housing for movement between a latched position retaining the striker and an unlatched position;

a pawl rotatably mounted to the housing for movement in and out of a pawl engagement position in which said pawl engages said ratchet to maintain said ratchet in said latched position; and a motion restriction device disposed along said housing and abutting against said pawl, said motion restriction device including a container at least partially filled with a velocity-dependent material that transitions between a first state, in which said container permits said pawl to move out of said pawl engagement position, and a second state, in which said container prevents movement of said pawl out of said pawl engagement position to maintain said ratchet in said latched position, wherein said velocity-dependent material transitions from said first state to said second state in response to a compressive force applied at a rate that is beyond a predetermined threshold to said velocity-dependent material.

2. A door latch assembly as set forth in claim 1 wherein said container is compressible.

3. A door latch assembly as set forth in claim 1 wherein said container is formed from an elastomeric material.

4. A door latch assembly as set forth in claim 1 wherein said container is a capsule.

5. A door latch assembly as set forth in claim 1 wherein said container is a tubular member.

6. A door latch assembly as set forth in claim 5 wherein said tubular member is compressible and biases said pawl towards said pawl engagement position.

7. A door latch assembly as set forth in claim 1 wherein said container is a cylinder.

8. A door latch assembly as set forth in claim 7 including a piston rod having a portion disposed within said cylinder and movable relative thereto.

9. A door latch assembly as set forth in claim 8 including a piston fixedly secured to said piston rod and disposed within said cylinder.

10. A door latch assembly for selectively retaining a striker disposed along a motor vehicle body, said door latch assembly comprising:

a housing adapted to be fixedly secured to a motor vehicle door;

a ratchet rotatably mounted to the housing for movement between a latched position retaining the striker and an unlatched position;

a pawl rotatably mounted to the housing for movement in and out of a pawl engagement position in which said pawl engages said ratchet to maintain said ratchet in said latched position; and a motion restriction device operably coupled to said pawl to receive a force, said motion restriction device including a container at least partially filled with a velocity-dependent material that transitions between a first state and a second state such that when said pawl moves out of said pawl engagement position sufficiently slowly a compressive force is applied to said velocity-dependent material in said container at a rate that is below a predetermined threshold so as to cause said velocity-dependent material to be in said first state and permit said pawl to move relative to said container out of said pawl engagement position, and when said pawl moves out of said pawl engagement position sufficiently quickly a compressive force is applied to said velocity-dependent material in said container at a rate that is above the predetermined threshold causing said velocity-dependent material to be in said second state and prevent said pawl from moving out of said pawl engagement position.

11. A door latch assembly as set forth in claim 10 wherein said container is compressible.

12. A door latch assembly as set forth in claim 10 wherein said container is formed from an elastomeric material.

13. A door latch assembly as set forth in claim 10 wherein said container is a capsule.

14. A door latch assembly as set forth in claim 10 wherein said container is a tubular member.

15. A door latch assembly as set forth in claim 14 wherein said tubular member is compressible and biases said pawl towards said pawl engagement position.

16. A door latch assembly as set forth in claim 10 wherein said container is a cylinder.

17. A door latch assembly as set forth in claim 16 including a piston rod having a portion disposed within said cylinder and movable relative thereto.

18. A door latch assembly as set forth in claim 17 including a piston fixedly secured to said piston rod and disposed within said cylinder.

19. A door latch assembly for selectively retaining a striker disposed along a motor vehicle body, said door latch assembly comprising:

a housing adapted to be fixedly secured to a motor vehicle door;

a ratchet rotatably mounted to the housing for movement between a latched position retaining the striker and an unlatched position;

a pawl rotatably mounted to the housing for movement in and out of a pawl engagement position in which said pawl engages said ratchet to maintain said ratchet in said latched position; and a motion restriction device including a container abutting said pawl and biasing said pawl towards said pawl engagement position, said container at least partially filled with a velocity-dependent material that transitions between a first state, in which said container permits said pawl to move out of said pawl engagement position, and a second state, in which said container does not permit movement of said pawl out of said pawl engagement position, wherein said velocity-dependent material transitions from said first state to said second state in response to a compressive force applied at a rate that is beyond a predetermined threshold to said velocity-dependent material.

20. A door latch assembly as set forth in claim 2 wherein said pawl directly engages said container and compresses said container in response to movement of said pawl out of said pawl engagement position.

21. A door latch assembly as set forth in claim 11 wherein said pawl directly engages said container and compresses said container in response to movement of said pawl out of said pawl engagement position.

* * * * *